United States Patent [19]

Steele et al.

[11] Patent Number: 4,876,775

[45] Date of Patent: Oct. 31, 1989

[54] YARN SHEET TRANSFER SYSTEM

[75] Inventors: Joseph A. Steele, Greensboro; Kenneth A. Byrd, Aberdeen, both of N.C.

[73] Assignee: Burlington Industries, Inc., Greensboro, N.C.

[21] Appl. No.: 145,532

[22] Filed: Jan. 18, 1988

[51] Int. Cl.[4] ..... D02H 5/00

[52] U.S. Cl. ..... 28/190; 28/193; 28/201; 28/208; 28/212; 242/131.1

[58] Field of Search ..... 28/193, 199, 201, 208, 28/212, 190; 242/131.1

[56] References Cited

U.S. PATENT DOCUMENTS

| | | | |
|---|---|---|---|
| 186,045 | 1/1877 | Rice | 242/131 |
| 1,869,277 | 7/1932 | Puig et al. | 28/212 |
| 2,050,775 | 8/1936 | Alderman | 242/131.1 XR |
| 2,116,766 | 5/1938 | Phillips | 28/199 |
| 2,534,340 | 12/1950 | Chaya et al. | 28/172 |
| 2,696,653 | 12/1954 | Park | 28/212 XR |
| 2,938,259 | 5/1960 | Stock | 28/199 |
| 3,317,979 | 5/1967 | Furst | 28/199 |
| 3,377,677 | 4/1968 | Furst | 28/193 |
| 3,415,463 | 12/1968 | Furst | 242/131 |
| 3,441,991 | 5/1969 | Bryan Jr. . | |

FOREIGN PATENT DOCUMENTS

| | | | |
|---|---|---|---|
| 2829111 | 1/1980 | Fed. Rep. of Germany | 28/208 |
| 3105461 | 9/1982 | Fed. Rep. of Germany . | |
| 2032074 | 11/1970 | France | 28/201 |
| 330614 | 6/1930 | United Kingdom | 242/131.1 |
| 760918 | 11/1956 | United Kingdom | 28/193 |
| 1136580 | 12/1968 | United Kingdom | 28/208 |

OTHER PUBLICATIONS

P. R. Lord and M. H. Mohamed, Weaving: *Conversion of Yarn to Fabric*, pp. 83–88, (1973).

*Primary Examiner*—Robert R. Mackey
*Attorney, Agent, or Firm*—Rhodes and Coats

[57] ABSTRACT

A method of converting a warping arrangement having two creel halves and a warper from a setup for long lots of one style to a setup for shorter lots. The method includes converting transfer package positions on each of the creel halves to running package positions and providing a yarn sheet transfer device associated with each creel half to permit the recreeling of each creel half by placing leading ends of newly recreeled yarn packages into yarn guides on the yarn sheet transfer device associated with the creel half while yarns from the other creel half are running to the warper through a yarn sheet transfer device associated with the other creel half.

19 Claims, 3 Drawing Sheets

FIG. 5
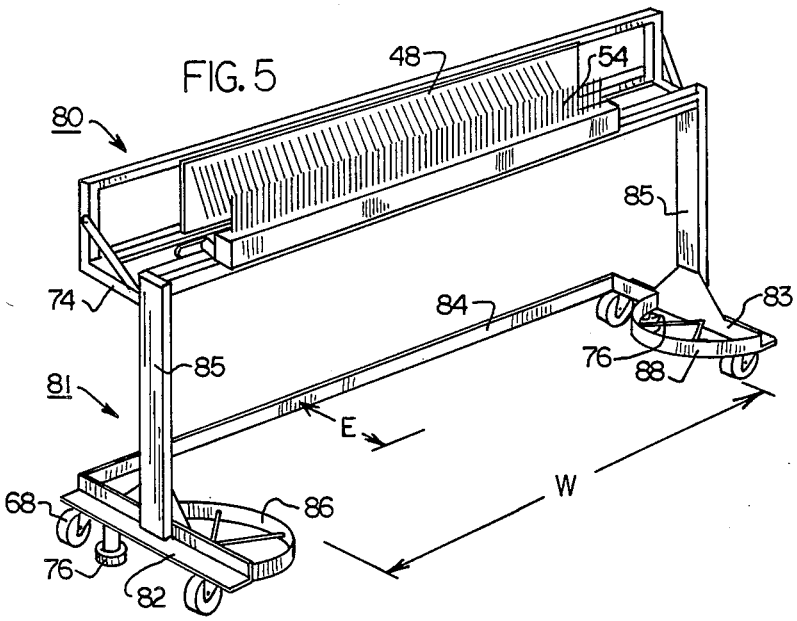
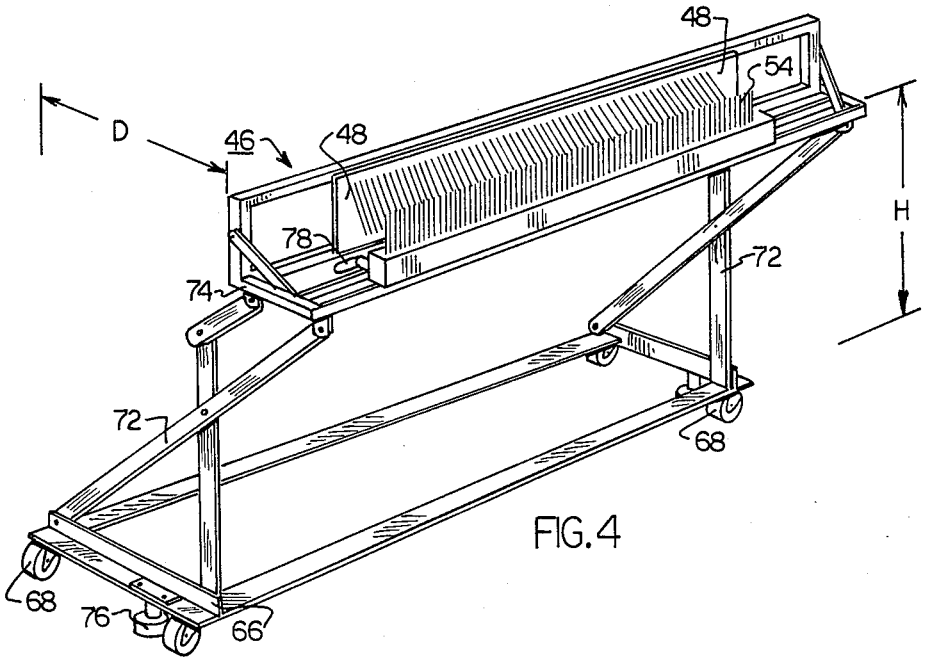
FIG. 4

YARN SHEET TRANSFER SYSTEM

BACKGROUND OF THE INVENTION (1) Field of the Invention

The present invention relates in general to a method and apparatus for forming a section beam and in particular to a new and novel yarn sheet transfer apparatus for such a system.

(2) Description of the Prior Art

Section beams are generally formed by a batch-type process. Individual warp yarn packages first are mounted within a creel with typically between 400 to 700 individual warp yarn packages being required. Next, warp yarn from each package is withdrawn under uniform tension and parallelized by means of a comb or Vee-reed to form a yarn sheet. Maintaining uniform yarn tension is well-known to be a key factor in preventing end breaks during the section warping process.

After parallelization, the yarn sheet is wound upon a take-up spool by a warping machine to form the section beam. When the spool is filled, the yarn sheet is cut and taped and the completed section beam is removed. Additional section beams are wound until the required yardage of a particular warp yarn is accumulated.

The yardage of a particular warp style so produced has traditionally been greatly in excess of the yards of yarn available on a typical creeled package. Thus, in order to maintain continuous warping for as long as possible, "running package" and "transfer package" positions are provided for each warp end on the creel. This allows the yarn from the running end to be fed to the warper while the transfer package position is tied to the trailing end of the running package so that when the running package is depleted, yarn is withdrawn from the transfer package. Then, the prior running package position may be recreeled as the transfer package position. This results in the creel having twice as many package positions as there are warp yarn ends.

When a yarn sheet of a different color, pattern, weight, or count is required, the warping machine must be stopped until all the individual warp yarn packages are replaced, which may take several hours. With the trend to smaller lots of specialty fabrics and, the increase of actual spool winding speeds to greater than 1000 yds/min., considerable attention has been paid to creel design with the object of reducing recreeling time and, at the same time, maintaining uniform tension on the individual warp yarns. One such system, illustrated in U.S. Pat. No. 3,441,991, utilizes creel "trucks" in which one or more creels are movably mounted on wheels or tracks with respect to a fixed warping machine. An entire creel truck is replaced with another creel truck having the desired number and type of yarn packages. Still another such system is a "duplicated" creel in which two fixed creels are employed side-by-side and the warping machine is movably mounted on rails so that it can be moved laterally from one creel to another. A variation of the duplicated creel is shown in German Pat. No. DE-3,105,461 in which a pair of fixed creels are located at the front and rear sides of a warping machine which is mounted on a turntable so that it can be rotated from one creel to another.

Certain disadvantages become apparent with such designs. First, either the creel or the warping machine must be specially built to be movable with respect to one another, requiring a substantial capital investment. Second, the steps of withdrawing the warp yarn from the individual packages under uniform tension and parallelizing to form the yarn sheet cannot be performed until the replacement creel and warping machine have been aligned with respect to one another.

Thus, it has become desirable to develop a yarn sheet transfer system for a section beam warping machine that will permit the quick change from one creel half to another without the need for special creels or warping machines while at the same time permitting the concurrent withdrawing of the warp under uniform tension and parallelization of the yarn sheet prior to the alignment of the replacement creel with respect to the warping machine.

SUMMARY OF THE INVENTION

The present invention solves the aforementioned problems associated with the prior art by providing a yarn sheet transfer system that uses a transfer device to transfer yarn sheets from either of two independent stationary creels to a common stationary warping machine. The yarn sheet transfer system includes two yarn sheet transfer devices each having a structural steel frame, an upstream and a downstream expansion comb mounted to the frame, and wheels or rollers attached to the frame for movement between a first run position and a second idle position. The expansion combs are mounted on the frame of each yarn transfer device so as to be in their correct alignment positions for the run position. In addition, the downstream comb may be detached from the yarn transfer device in the run position or reattached in the idle position near the upstream comb to provide a more compact device. A circular guide rail at ground and/or head levels is configured to allow proper alignment to the run and idle position. The yarn transfer device includes a locking mechanism that insures the yarn transfer device is in correct alignment with the warping machine when in the run position and also to insure that the transfer device is in its correct position when in the idle position. When used with an existing magazine-type creel having double-cone holders, the creel may be retrofitted with sufficient additional tensioners, stop motion feelers, eyelets, and eyebars to allow creeling and running of a full lot from either half of the creel independently.

Accordingly, one aspect of the present invention to provide an apparatus for forming a warp beam that is operable to permit the quick change from one creel to another.

Another aspect of the present invention is to provide a yarn sheet transfer device for a yarn sheet transfer system that is operable to maintain the yarn sheet properly parallelized during transfer from one position to another.

Still another aspect of the present invention is to provide a yarn sheet transfer system for a section beam warping machine that is operable to maintain the warp yarn tension of the yarn sheet during the change from an idle position to a run position.

These and other aspects of the present invention will be more clearly understood after a review of the following descriptions of the preferred embodiments of the invention when considered with the drawings.

BRIEF DESCRIPTION OF THE DRAWINGS

FIG. 4 is a perspective view of an alternative embodiment of the yarn sheet transfer device as utilized by the present invention.

FIG. 5 is a perspective view of a preferred embodiment of the yarn sheet transfer device as utilized by the present invention.

DESCRIPTION OF THE PREFERRED EMBODIMENT(S)

Figure 1:
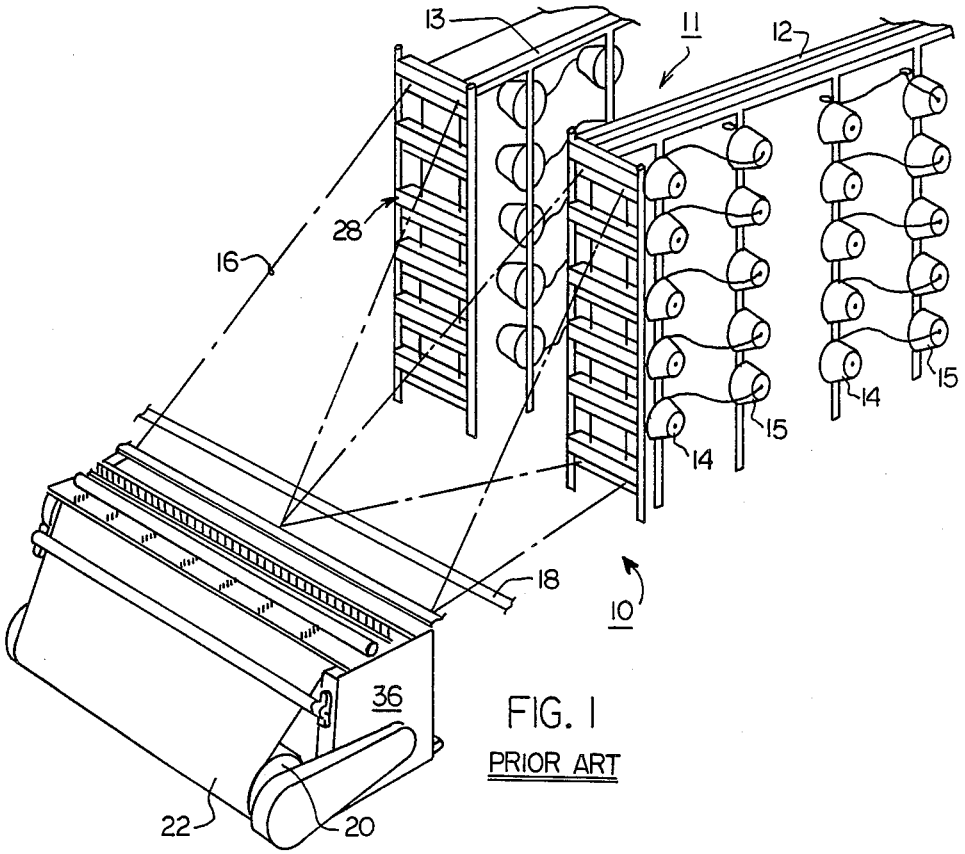
FIG. 1 PRIOR ART
FIG. 1 is a perspective view of an apparatus for producing a section beam as previously known in the prior art.

Referring now to the drawings, it will be understood that the illustrations in FIGS. 2 through 6 are for the purpose of describing a preferred embodiment of the invention and are not intended to limit the invention thereto.

As best seen in FIG. 1, a conventional section beam warping arrangement, generally designated 10, is shown. The apparatus consists of a stationary creel 11 made up of two halves, 12 and 13, for supporting a plurality of running supply packages 14 of warp yarn. The individual warp yarn ends are passed through, eyelets, 28, and tension and broken end stop motion devices (not shown) to form a yarn sheet 16. The yarn sheet 16 is parallelized by yarn guides 18, which can be any of a number of well-known devices including combs, expansion combs, Vee-reeds, and eyelet boards. After parallelization, the yarn sheet 16 is wound by warper 36 on spool 20 to form section beam 22.

Also provided on creel 11 are transfer packages 15 of yarn, the leading ends of which are tied to trailing ends of respective running packages 14. Thus as a package 14 runs out, the tension on the yarn to the warper 36 immediately pulls the yarn from the associated transfer package 15. The depleted package 14 is then replaced with a full package and its leading end is tied to the trailing end of the package 15, now a running package. This process is continued repeatedly until enough yards of a style of warp are beamed. When a new warp style is to be prepared, all existing packages 14 and 15 must be recreeled with yarns for the new style. Recreeling is a time consuming process during which the warper is essentially idle.

The proportion of idle time becomes prohibitively expensive if the creel 11 has to be changed out often. In addition, if the yards of a given style of warp to be beamed are minimal, the initial running package 14 may be sufficient to provide such yardage, so that the transfer package 15 is not needed. Applicants have found a way to take advantage of the latter, to overcome the problem of the former.

This is accomplished by providing a yarn sheet transfer system which includes two yarn sheet transfer mechanisms, one each associated with an existing creel half. Thus, both the running and transfer positions 14 and 15 of the creel 11 can be made running positions, so only one half of the creel need be used. It can be a "running half" as the other half is being recreeled with a new style. The leading ends of the yarn in the recreeled side are properly parallelized and positioned by placement in an associated yarn sheet transfer mechanism.

Figure 2:
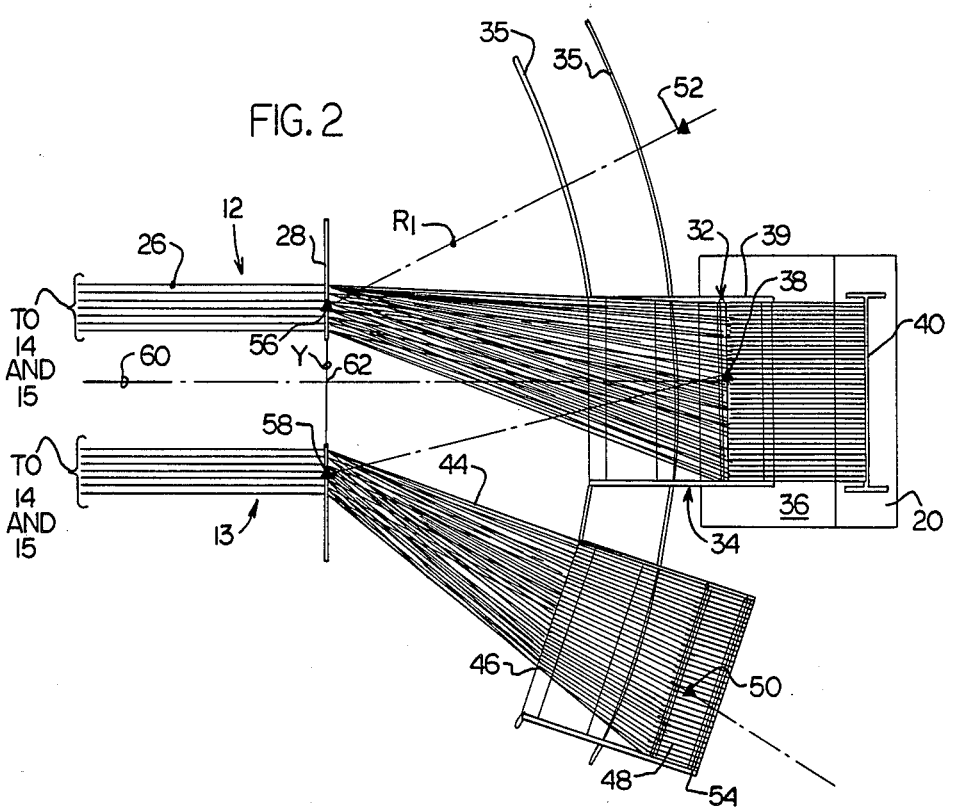
FIG. 2 is a plan view of a preferred embodiment of the yarn sheet transfer system of the present invention.

Referring now to FIG. 2, an embodiment of the yarn sheet transfer system of the invention is illustrated. Warp yarn ends 26 from warp yarn supply packages (not shown but located on all positions of a creel half, such as creel half 12 shown in FIG. 1) are passed through a plurality of eyelets (not shown) mounted to first creel half 12 to form first yarn sheet 31. First yarn sheet 31 passes through first upstream yarn guides 32 mounted on and part of first yarn transfer device, generally designated 34. First yarn transfer device 34 is movably mounted on circular guide rails 35 at ground level. Guide rails 35 are configured to allow proper alignment of warp sheet 31 and first upstream yarn guide 32 with warping machine 36. A locking mechanism 76 (see FIGS. 4 and 5) insures that first yarn sheet transfer device 34 remains in correct alignment with stationary warping machine 36 at run position 38. First downstream yarn guide 40 is detachably mounted to a recreel position 39 on yarn sheet transfer device 34 and is secured to the warper 36 when yarn sheet transfer device 34 is at run position 38.

Second creel half 13 is located adjacent to first creel half 12. Second yarn sheet 44 passes from second creel half 13 to second yarn sheet transfer device, generally designated 46, and in a similar manner as first yarn sheet 31. Second upstream yarn guide 48 and second downstream yarn guide 54 are also provided, identical with their abovementioned counterparts. Likewise, second yarn sheet transfer device 46 is also movably mounted on circular rails 35. A locking mechanism 76 (see FIGS. 4 and 5) insures that second yarn sheet transfer device 46 remains in proper alignment with idle position 50. In a like manner, a second idle position 52 is provided for first yarn sheet transfer device 34. In the preferred embodiment, idle positions 50 and 52 are located equidistantly from pivot points 56 and 58, respectfully, and at substantially the same distance as run position 38. The selection of idle position 50, 52 at such a equidistant points insures that the yarn sheet tension is substantially equal at the idle position 50, 52 and run position 38. Preferably the rails 35 are situated so that the transfer devices are so located by movement along the rails. Other positioning methods may also be used, including merely "eyeballing".

Figure 3:
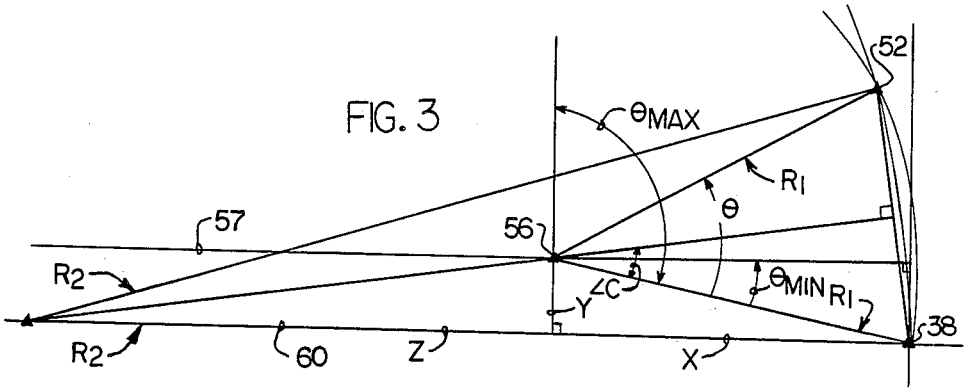
FIG. 3 is a schematical plan view of the preferred embodiment shown in FIG. 2 illustrating the spatial relationships between the idle and run positions.

The spatial relationship between the run position 38 and the idle positions 50, 52 can be best seen in FIG. 3. For the sake of simplicity, only run position 38 and idle position 52 for first yarn transfer device 34 are shown. First creel half 12 centerline 57 is parallel and axially offset at a distance Y from centerline 60, the line of equidistance between the pair of stationary creel halves. First creel half pivot point 56 is equidistant ($R_1$) from both run position 38 and idle position 52 in order that the warp yarn tension at run position 38 and idle position 52 be substantially equal. In the preferred embodiment, the desired radius, $R_2$, of guide rails 35 can be calculated when Y, $R_1$, and $\theta$, the angle between run position 38 and idle position 52, are known, according to the following relationship derived from simple trigonometry:

(1) $R_2 = Z + X$ (2) $R_2 = Y^*[\tan(180° - (\cos^{-1} Y/R_1 + \theta/2))] + (R_1{}^2 - Y^2)^{\frac{1}{2}}$ In addition, $\theta_{min}$, the angle defining the minimum radius for guide rails 35 which would not interfere with warping machine 36, and $\theta_{max}$, the angle where run position 52 would be at 90° with respect to first creel centerline 57, can also be calculated as:

(3) $\theta_{min}=\sin^{-1}Y/R_1$ (4) $\theta_{max}=\theta_{min}/2+90°$

Thus, for example where Y is 4.5 feet and $R_1$ is 22 feet, equations (3) and (4) can be solved to yield $\theta_{min}=24°$ and $\theta_{max}=102°$, respectively. If $\theta$ is then selected between these limits at, for example 40°, solving equation (2) will yield a desired value of 52.7 feet for $R_2$. Thus, guide rails 35 are configured to allow proper alignment to both run position 38 and idle position 52 without interference with warping machine 36.

Turning now to FIG. 4, an alternate embodiment of the yarn sheet transfer device, generally designated 46, is shown. Yarn sheet transfer device 46 includes a base 66 to which a plurality of wheels 68 are attached by bolts or frame 72 is welded to the upper surface of base 66 and supports the lower surface of yarn guide support 74. The dimensions D and H, shown in FIG. 4, are chosen to provide sufficient clearance with respect to warping machine 36 and to provide correct alignment of yarn guides 48, 54 in run position 38 (see FIG. 2). Locking mechanism 76 is mounted by bolts or welded to base 66 and is selectively operable either to prevent or allow movement of yarn sheet transfer device 46. Locking mechanism 76 can be any conventional type of mechanism including, wheel locks, foot stops, or insertable pins. Another locking mechanism 78 is mounted by bolts or welded to yarn guide support 74 and is selectively operable either to secure downstream yarn guide 54 to yarn guide support 74 or to release downstream yarn guide 54 for engagement with warping machine 36.

Turning to FIG. 5, a preferred embodiment of the yarn sheet transfer device, generally designated 80, is shown. Yarn sheet transfer device 80 differs from the previously discussed yarn sheet transfer device 46 in that device 80 is designed to be used without guide rails 35. Yarn sheet transfer device 80 consists of a base generally designated 81 to which a plurality of wheels 68 are attached by bolts or welding. Base 81 includes a structural steel longitudinal member 84 perpendicular to and welded to a pair of structural steel arms 82, 83 in such a manner as to form a "C" shape. A pair of steel, curved side positioning means, 86, 88 are welded to arms 82, 83. The lengths of longitudinal member 84 and side arms 82, 83 are selected such that dimensions W and E will accommodate the width of warping machine 36 and place yarn guides 48, 54 in proper alignment to run position 38. A post-type structural steel frame 85 is welded to the upper surface of base 81 and supports the lower surface of yarn guide support 74. Locking mechanisms 76 are mounted by bolts or welded to base 81 and are selectively operable either to prevent or allow movement of yarn sheet transfer device 80. Locking mechanism 76 can be any conventional type of mechanism including wheel locks, foot stops, or insertable pins. Another locking mechanism 78 is mounted by bolts or welded to yarn guide support 74 and is selectively operable either to secure downstream yarn guide 54 to yarn guide support 74 or to release downstream yarn guide 54 for engagement with warping machine 36.

Figure 6:
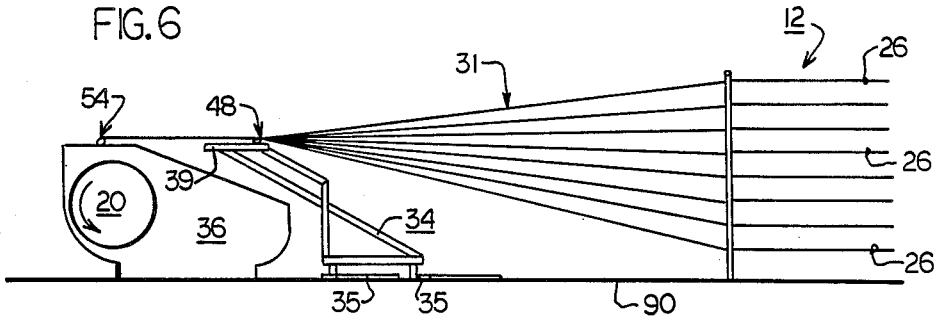
FIG. 6 is a side elevational view of the yarn sheet transfer system shown in FIG. 2.

Turning finally to FIG. 6, a side elevational view is shown of the yarn sheet transfer system of the present invention configured with guide rails 35 mounted to floor 90. In an alternative embodiment, (not shown), yarn sheet transfer device 80 could be movably mounted to an overhead track. Both mounting systems are functionally equivalent but one may be preferable over the other for a specific plant location.

In operation, after old yarn sheet 31 has been wound on spool 20 to form section beam 22, old yarn sheet 31 is cut and the ends connected to spool 20 are taped to the surface of completed section beam 22. Completed beam 22 is then removed from warping machine 36 and first downstream yarn guide 40 is then released from warping machine 36 and secured to first yarn sheet transfer device 34 at recreel position 39. First yarn sheet transfer device 34 is moved along guide rails 35 to idle position 52. Locking mechanism 76 is engaged to secure first yarn sheet transfer device 34 in proper alignment with first creel half 12. The depleted yarn packages are removed from creel half 12 and replaced with fresh packages. The individual yarn ends 26 are passed through tension and broken end stop motion devices, as needed, to form new yarn sheet 31. Yarn sheet 31 is parallelized by yarn guides 32, 40, of first yarn sheet transfer device 34 and secured by tape to await its turn at warp machine 36.

Meanwhile, second yarn sheet transfer device 46 has had its locking mechanism 76 released and is moved from idle position 50 to run position 38, where it is aligned with warping machine 36. Locking mechanism 76 is engaged to insure that second yarn sheet transfer device 46 remains so aligned. Second downstream yarn guide 54 is released from second yarn sheet transfer device 46 by releasing locking mechanism 78 and secured by engaging locking mechanism 78 to warping machine 36. New yarn sheet 44 is engaged and wound on new spool 20 to form new section beam 22.

The above process is repeated with yarn sheet transfer devices 34, 46 being sequentially moved to and from their respective idle positions 52, 50 and common run position 38 along guide rails 35. The time required to cut and tape an old yarn sheet, move the downstream comb back to its yarn sheet transfer device, move that yarn sheet transfer device to its idle position, move and align the second yarn sheet transfer device with the warping machine, and engage the new yarn sheet with the take-up spool will usually be less than ten minutes. The process is essentially the same using the apparatus as embodied in the preferred embodiment of FIG. 5 without guide rails except that some provision is made, for example, marks on floor 90, to provide an indication of the position for correct alignment of the yarn sheet transfer devices with respect to their respective creel halves and their respective idle positions.

Certain modifications and improvements will occur to those skilled in the art upon reading the foregoing descriptions. By way of example, the cantilevered, structural steel frame of the yarn sheet transfer devices may be modified to include adjustment means, such as telescoping sections, to provide improved alignment with the warping machine. All such modifications and improvements are within the scope of the following claims.

We claim:

1. An apparatus for forming a warp beam, comprising:

(a) first stationary warp yarn supply means for supplying a plurality of warp yarns from yarn packages;

(b) second stationary warp yarn supply means for supplying a plurality of warp yarns from yarn packages;

(c) means for winding warp yarns onto a spool to form a warp beam; and (d) warp yarn transfer means located between said first and second warp yarn supply means and said means for winding for supplying warp yarns to said means for winding, said transfer means being selectively engagable between either of said first and second supply means and said means for winding to permit yarn to be wound onto the spool from the yarn packages on the selected supply means, wherein said warp yarn transfer means includes as transfer device operatively associated with each of said warp yarn supply means and movable between an operable position and an inoperable position with respect to said winding means and the associated warp supply means.

2. The apparatus according to claim 1, wherein said second warp yarn supply means is positioned adjacent to said first warp yarn supply means.

3. The apparatus according to claim 1, wherein said means for winding is stationary.

4. The apparatus according to claim 1, wherein said inoperable position is convenient for receiving yarn ends from yarn packages being recreeled on the warp yarn supply means associated with the yarn transfer device.

5. The apparatus according to claim 1, wherein said operable and said inoperable positions are approximately equidistant ($R_1$) from said associated warp yarn supply means, thereby maintaining said warp yarns under substantially equal tension.

6. The apparatus according to claim 5, wherein the included angle in degrees between said operable and inoperable positions, $\theta$, is greater than or equal to $\theta_{min}$, where $\theta_{min}=\sin^{-1}Y/R_1$ wherein Y is the distance the vertex of the included angle $\theta$ is offset from the line of equidistance between said first and second yarn supply means.

7. The apparatus according to claim 6, wherein the included angle in degrees between said operable and inoperable positions, $\theta$, is less than $\theta_{max}$, where $\theta_{max}=\theta_{min}/2+90°$.

8. The apparatus according to claim 7 including guide means for aligning said warp yarn transfer device in said operable and inoperable positions.

9. The apparatus according to claim 8, wherein said guide means is a semi-circular guide rail having a radius approximately equal to $R_2=Y*[\tan(180°-(\cos^{-1}Y/R_1+\theta/2))]+(R_1^2-Y^2)^{\frac{1}{2}}$.

10. The apparatus according to claim 1, including guide means for maintaining the alignment of said warp yarn transfer device in said operable and inoperable positions.

11. The apparatus according to claim 10, wherein said guide means is a guide rail.

12. The apparatus according to claim 1, wherein said warp yarn transfer means includes:

(a) a frame;

(b) yarn guide means attached to said frame for receiving individual warp yarn ends of said plurality of warp yarns and supplying said individual warp yarns to said means for winding;

(c) a plurality of floor engaging wheels attached to said frame for providing mobility to position said frame in alignment with said means for winding.

13. The device according to claim 12, wherein said frame is cantilevered to permit movement with respect to said means for winding.

14. The device according to claim 12, wherein said yarn guide means includes an upstream yarn guide and a downstream yarn guide, said downstream yarn guide being substantially parallel to said upstream yarn guide.

15. The device according to claim 14, wherein said downstream yarn guide includes a locking mechanism selectively operable to secure said downstream yarn guide to said frame or to said means for winding.

16. The device according to claim 12, including locking means for securing said warp transfer means to insure said means remains in alignment with said means for winding.

17. The device according to claim 16, wherein said locking means comprises at least one foot-operable floor stop.

18. The device according to claim 12, including positioning means in the form of a pair of curved members attached to the base of said frame to define a slot therebetween for embracing said means for winding, said slot being substantially equal to the width of said means for winding.

19. The device according to claim 12, wherein said floor engaging wheels are configured to follow a guide rail.

* * * * *